US006498327B1

(12) United States Patent
Thelander

(10) Patent No.: US 6,498,327 B1
(45) Date of Patent: Dec. 24, 2002

(54) METHOD FOR INDUCTIVE HEATING AND MONITORING

(76) Inventor: Ulf Thelander, Storgatan 10, S-330 12 Forsheda (SE)

( * ) Notice: Subject to any disclaimer, the term of this patent is extended or adjusted under 35 U.S.C. 154(b) by 0 days.

(21) Appl. No.: 09/857,359

(22) PCT Filed: Dec. 3, 1999

(86) PCT No.: PCT/SE99/02265

§ 371 (c)(1),
(2), (4) Date: Jun. 4, 2001

(87) PCT Pub. No.: WO00/35249

PCT Pub. Date: Jun. 15, 2000

(30) Foreign Application Priority Data

Dec. 4, 1998 (SE) ..... 9804216

(51) Int. Cl.[7] ..... H05B 6/08; H05B 6/40

(52) U.S. Cl. ..... 219/635; 219/667; 219/665; 219/670; 219/672; 219/673; 425/174.8 E

(58) Field of Search ..... 219/665, 667, 219/670, 672, 676, 635, 663, 650, 673; 425/174.8 R, 174.8 E

(56) References Cited

U.S. PATENT DOCUMENTS 3,639,718 A * 2/1972 Castonguay et al. ..... 219/651
3,684,852 A * 8/1972 Seyfried ..... 219/665
3,814,827 A * 6/1974 Stut ..... 219/638
4,931,945 A * 6/1990 Taguchi et al. ..... 219/665
5,223,683 A * 6/1993 Ishizaka ..... 219/608
5,373,144 A 12/1994 Thelander ..... 219/659

FOREIGN PATENT DOCUMENTS

EP 0 481 653 A2 10/1991 ..... G01J/5/00
EP 0 594 308 A1 9/1993 ..... B22D/46/00
JP 5-54961 * 3/1993 ..... 219/665

* cited by examiner

*Primary Examiner*—Philip H. Leung
(74) *Attorney, Agent, or Firm*—Hayes Soloway P.C.

(57) ABSTRACT

A method for transverse flux induction heating using a heating machine including an iron core, that essentially has a U-shape with an opening facing downwards. The legs lie in contact with downwards facing displaceable core jaws. These are so arranged that they are displaceable towards and from each other by means of pneumatic pistons. The object that is to be heated is placed between the core jaws. The core jaws are at the displacement guided by means of U-shaped rails and rolls or linear bearings. The displacement serves among other things to free the object that is to be heated or has been heated for transport into and out from the machine. When the right position has been reached the displacement is stopped and the two core jaws are locked by a pressurized bellow pressing the core jaws upwards against the legs of the U-shaped core. In this way a locking and a securing of as good contact as possible is obtained between the moveable core jaws and the U-shaped core so that the field is hindered as little as possible. Monitoring of heat parameters is done using one or more cameras.

10 Claims, 1 Drawing Sheet

METHOD FOR INDUCTIVE HEATING AND MONITORING

BACKGROUND OF THE INVENTION

The present invention relates generally to the field of inductive heating and in particular transverse flux induction heating. The object of the invention is to provide a more efficient and precise method of controlling the heating of an object.

One source of difficulties with inductive heating is that the properties and structure of the heating machinery will inevitably change with time. The powerful magnetic fields in the core will magnetize the different parts. Because the field is alternating the parts will possibly vibrate relative to each other. Over time, this means mechanical wear on the core. The ends of the core close to the object being heated become frayed causing changes in the field at and through the object. The part of the core close to the object being heated also becomes hot. This contributes to changes in the core and thus the magnetic field distribution. If the objects that are to be heated differ, for instance extrusion tools with different aluminum profiles, this also changes the heating circumstances.

For instance, when heating extrusion tools made of metals and alloys, in particular aluminum, an increased precision in controlling the heating is desired. These tools, before their use, must be heated in order to allow the aluminum to be pressed through the tool. Otherwise the aluminum "freezes solid" and the tool might break. Conventionally, the tools are heated for many hours or days in an oven before the extrusion tool is mounted in the extruding machine. In the beginning of the extrusion process, neither the quality nor the quantity that is obtained for the extruded profiles is acceptable and one must wait a while before good quality and full production speed can be achieved. This occurs when the surface of the tool that is in contact with the aluminum has arrived at essentially the same temperature as the heated aluminum. Also, if a tool is inserted too cold, the risk that it breaks is great, because heat tensions may arise and the pressure from the press is very large.

SUMMARY OF THE INVENTION

In view of these problems, it is the object of the present invention to provide a method of inductive heating for an object and the monitoring of the heating, thereby dealing with the aforementioned issues.

In accordance with this invention, the problems with wear on the heating machinery are dealt with by monitoring the heating and adjusting it, if needed. The heating parameters may be altered by: changing the core topography at the surface facing the object to be heated; or by altering the relative positions of the core and the object to be heated; or combinations thereof so for instance a non-uniform heating can be counteracted. Also, the current fed to the magnetizing coils can be adjusted.

Additionally, the invention undertakes the heating of an extrusion tool before its mounting in the press by means of induction whereby the local temperature distribution may become very close to what exists during the continuous extruding process.

It also diminishes the time before the quality of the extrusion profile is acceptable and limits the loss due to rejection at the beginning of the process. Therefore, frequent changes of the tools are possible, if desired, with only small storage requirements. Overall, this method is a good use of expensive extruding presses.

Moreover, the tools are not overheated by this process. This is a great benefit because in some cases, the peripheral parts do not have to be heated to the same temperature as the rest of the object. In other situations, the inner working surface of the tools does not need to be heated to its full working temperature until shortly before it is put to use. Uniform heating would occur if an oven was used, but this does not necessarily occur with this invention. This is advantageous because at the working temperature the air could easily corrode the tools.

The heat monitoring is accomplished by means of a heat camera. For example, this method can be used to find the proper profile for heating of an extrusion tool. First, an extrusion tool that was just used is lifted into the heating device and the heat camera(s) register(s) the heat picture. This picture is then stored. Next time that tool needs to be used, it is heated as close as possible to the previous heat picture or the proper heat picture is extrapolated for when the tool is functioning properly.

Also, another application is crimp fittings (railroad wheels on axles, for instance). The controllable heating in accordance with the invention may find use in the hardening of cogwheels, cog, etc. because it minimizes use of effort and time, and reduces the strain and temperature influence on treated objects due to non-uniform heating. Similarly, for ball bearing races, the heating can be controlled to achieve a uniform heating.

In accordance with this invention, the control of the heat generation may, for instance, be achieved by the use of specific adaptors between the object that is to be heated and the magnetic core, thereby closing the magnetic field in the heating device. Alternatively, the adaptation method used can be varied with time. This can be done, for instance, by switching the adaptation means. By varying the times of the different adaptation means, it is possible to gain good control of the heating process.

In particular, the core or core jaw may include an elongated part that corresponds to an opening or channel in the core or core jaw. This channel is displaceable and extendable for the insertion into depressions of a heated object or can be slid through this if the opening in the heated object is large. For instance circular objects, such as ball bearing races, may be uniformly heated in this way, because the circular objects function as a secondary winding in a transformer. Because the current heating of the object is the same all the way around, the heating will be uniform. Even several races may be heated simultaneously by being fed or replaced one at a time in the heating location. By this method, the heating time may be multiplied by the number of races that are heated simultaneously. This can increase the feed speed. By monitoring only the races that have been there the longest and that are to be removed at the next feed interruption, the time or field strength can be controlled to give precisely the right temperature or heating conditions. Also, a high production rate is possible without sacrificing the time that the heated object has to remain heated in order to obtain the intended molecular reorganization before, for instance, cooling at hardening.

A further degree of freedom in the heating is obtained by varying the strength and frequency of the magnetic field. A lower frequency results in a deeper heating while a higher frequency results in a more superficial heating.

It is also possible to use magnetic shielding to reduce heating of specific parts or objects by screening or shortcircuiting of the field.

Further advantages and characteristics of the invention are apparent from the patent claims and the following description of an embodiment described with reference to the drawings.

DETAILED DESCRIPTION

Figure 1:
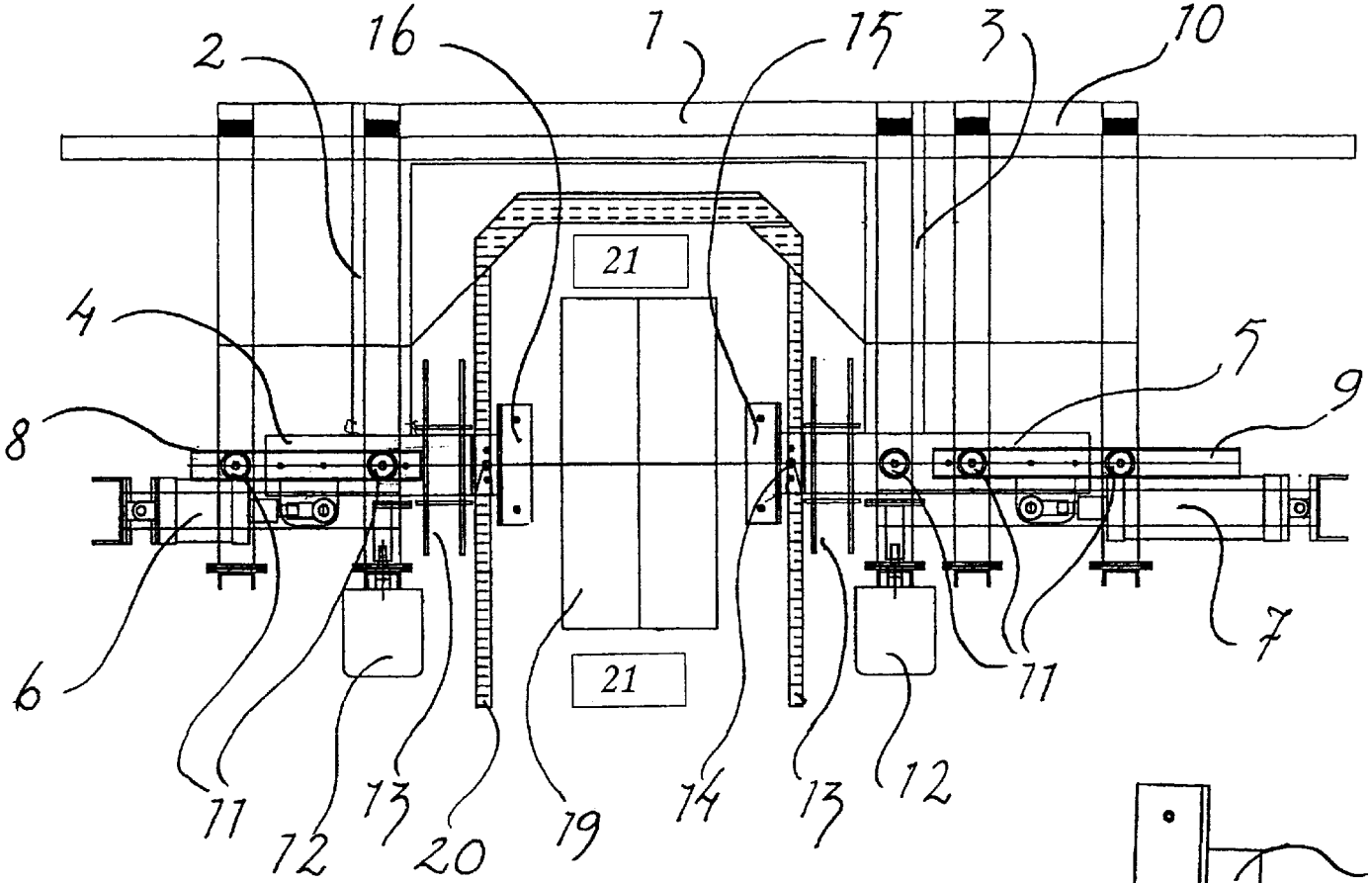
FIG. 1 illustrates an apparatus used in the method.
Figure 2:
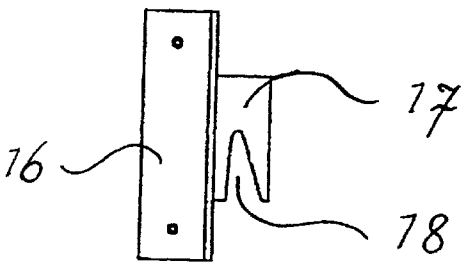
FIG. 2 is an adaptation piece that can be used with this invention.

The heating machine shown in FIG. 1 includes an iron core 1 closing magnetic flux loops. The core has an essentially U-shape design with the opening facing downwards. Against the downwards facing ends of the legs 2 and 3 are the displaceable core jaws 4, 5. These are so arranged that they are displaceable towards and away from each other by means of pneumatic pistons 6, 7. Between the core jaws the object 19 that is to be heated is placed. The core jaws are displaced towards and away from each other guided by means of U-shaped rails 8, 9 that run on rollers arranged in the frame of the machine. (As an alternative one can use linear bearings.) The displacement serves partly to free the object that is to be heated or has been heated for transport into or out from the machine. Also with this mobility, the core jaws can be placed the correct relative distance from the object required to achieve the correct heating conditions. When the correct position has been reached the displacement is stopped and the two core jaws 4 and 5 are locked by each being pressed up against the legs 2, 3 of the U-shaped core 1 by pressurized air from a bellow means 12. In this way, the object is locked in place and the best possible contact is obtained between the moveable core jaws and the U-shaped core, so that the field is hindered as little as possible.

The object that is to be heated can be inserted between the moveable core parts on a moveable roll table or the like. The object that is to be heated can control the heating, and be moveable laterally and heightwise, as well as circular, especially if it is a round object.

On each side of the object that is to be heated, a coil 13 is arranged around each core jaw. The coils are connected to a current source.

On each side of the object that is to be heated heat cameras 21 are arranged at the side of the coils for monitoring of the heating progress of the object. For instance, two, or alternatively, four cameras may be arranged on each side of the object and distributed over the circumference and turned obliquely in towards each other. Fiber optics may be used to allow viewing by the cameras more or less through the core jaws and adaption pieces.

The moveable core parts are in their front ends each provided with two horizontally, laterally projecting pins 14. On these pins adaption pieces 15, 16 can be hung for the adaption to different objects that are to be heated. These adaption pieces are provided with panels or flanges 17 that can grip over the core jaws. The flanges 17 of the adaption pieces are provided with V-shaped downwards facing recesses 18. When the adaption pieces 15, 16 are hung over the pins 14 they can grip over these pins. The oblique edges can slide on the pins pulling the adaption pieces against the core jaws. In this way, the adaption piece when mounting will automatically be pulled against the respective core piece so that good contact is achieved even if the movement precision is moderate. On the upper side or somewhere else, the adaption pieces may be provided with eyes or other gripping means. The lifting and mounting can be executed by hand or by means of a robot.

Before heating, the workpiece that is to be heated is first pushed into the heating area on a carriage (not shown) that is insulated from the core. Thereafter the two adaption pieces are mounted from above. When these are in place the core jaws are extended forward until the desired air gap or contact exists between the object that is to be heated and the adaption pieces of the core jaws. When this position has been reached, the jaws are locked by being pressed against the U-shaped iron core. Then, the coils are fed with AC of suitable amperage and frequency in order to achieve the heating that is desired.

During the heating the heat cameras monitor the progress of the heating, and the registered temperatures are compared with previously recorded temperature curves for the same tool. If the tool has not previously been used, a temperature curve from some similar tool can be used. Preferably, the monitoring is done with a computer (not shown) that may access temperature curves and other parameters stored for each tool so that one only has to indicate what tool it is to enable the computer to control the heating progress. If the adaption pieces need to be changed the current is switched off and the adaption pieces are exchanged, either automatically or by a person. Alternatively or in addition the position of the heated object may be adjusted or changed. If so desired, each tool may in order to reduce the risk of mistakes be provided with identification markings that can be read by suitable reading means. Starting from previously recorded temperature curves and temperature picture sequences, the heating time can be adapted to what is needed. Preferably, the computer may signal if too great or specific types of deviation from previous heatings are registered because this may indicate either that the wrong record has been accessed by the computer, or the wrong tool inserted, or that the tool has damage in the shape of cracks. For instance, the tool may have developed cracks at previous use but they have remained unnoticed because they are thin and difficult to see.

Additionally, by disrupting the current to the coils and withdrawing the core jaws or the dismounting of the adaption pieces, it is possible for the cameras to get pictures or a sequence of pictures of the entire heated surface, even during heating when the view may be partly obstructed. These disruptions need only take a few seconds and thus contribute only negligibly to the heating time. Instead, the gained information reduces the heating time. By letting the cameras register the progress of the heating while disrupting the heating only slightly a model of how the heat transport take place in the heated object is obtained. Based on this knowledge, it may be calculated how long the continued heating should take place.

The heating process can be adapted to each occasion because of the heat monitoring ability and adaption pieces available in this method. For instance, it is possible with the invented device to heat the tools that are used in the extruding of aluminum to almost the exact working temperature in advance and eliminate the waiting time for temperature balance to be established after extruding for a time with the right speed. During the extruding of aluminum, a temperature gradient will develop in the tool. The parts in contact with the hot aluminum will be the hottest and then the temperature falls away from the contact point. In the optimal case, the tool is heated to the same temperature relationship that exists during prior uses of the tool in the machine (with a possible addition for the cooling during mounting). In this way the risk of a tool breaking is minimized. Also, if the tool should break because of the heat tensions arising from heating this breakage will hopefully occur already during the heating before the inserting into the machine. Also energy consumption is minimized. This may not necessarily mean that the heating is to take place entirely from the center but one can very well imagine that at first a major part of the tool is heated and that then after a quick change of adaption pieces the central parts are heated to the final temperature, all in order to secure that the tools are subjected to as small strain as possible during heating as well as during use.

A further embodiment of the invention is when the core jaws are hollowed and the core jaws' moveable core pieces are arranged inside, for instance, to heat surfaces recessed in the workpiece. This is not unusual in connection with aluminum extraction tools. These inner core pieces may use the same method as used for the core jaws, that is, be lifted into contact with the surface located above for the purpose of locking and elimination of air gap. By bringing the different core parts into contact before the electric current is closed, the risk of excess pressure and the exertion of forces on the guides are eliminated; therefore longer life is achieved for the core parts. In cases where the workpieces that are to be heated are not too thick, the adaption pieces may be profiled in the depth direction.

Another embodiment is the use of several parallel core pieces that when positioned correctly are compressed by the lifting movement. The opening in the core, for instance, can be turned 90 degrees in relation to the outer profile so that a package of several core bars can be pressed together and locked. If using bars of the same length, viewing and adjusting the bars is easier. In the extreme case, several small separate core bars could be moved individually into contact before locking.

In the same way as the core jaws, the core pieces may be provided with mountable adaption pieces, that are possibly retractable together with the core pieces in the core jaws. In this case, it is not always possible to mount the adaption pieces before the workpiece is inserted between the core jaws, then if necessary they could be forced into position.

By lifting the core jaws up against the U-shaped core before the magnetic field is generated, the risk of excess pressure is eliminated. Also, the risk of deformation of the core parts is eliminated.

The device according to the invention can also be arranged to provide non-uniform heating of other objects, for instance railroad wheels. Railroad wheels need to be heated in the center in order to be crimped on an axle. Also, cogwheels can be heated along the outer edge for hardening of the cogs.

The heating can locally be distributed with different adaption pieces or by movement of the heated object. Furthermore, the heating of different parts may be distributed in time so that the desired result is achieved. Preferably the sequence of adjustments and adaption pieces is registered. As realized the invented device as well as the method are well suited for automatic work.

The invention is, further, very well suited for use in production lines for multiple products, for instance crimp mounting, hardening where in this way increased precision can be obtained and giving in turn a more uniform quality.

The use of adaption pieces provides not only an adaption of the magnetic field but provides also a protection for the actual core parts of the machine so that it does not have to come in direct contact with the heated object. By this interface, the heat transfer to the core jaws is hindered. The receiving area for the workpiece and the core jaws are screened from the machine by means of a panel 20 of stainless steel. Since the adaption pieces 15, 16 are larger than the openings for the core jaws in the panel 29, essentially, the heat radiation past the panel and out towards the coils is eliminated.

In the above described embodiment, the U-shaped core has its opening facing straight downwards. Other arrangements are of course also possible and in particular one can consider an arrangement where the core is inclined for adaption to workpieces that lean against a support on the transport carriage. By having both the core jaws moveable advantages are gained when dealing with heavy workpieces. The workpiece that is heated can continue to lean against its support on the carriage so that the core jaws do not have to take up the weight. By arranging the gripping points for lifting appropriately on the adaption means these may automatically be given the right angle for the mounting.

Electrically driven screws can be used instead of pneumatic pistons for the positioning of the core jaws and the central moveable pieces.

What is claimed is:

1. A method for inductive heating which comprises the steps of:

inserting an object to be heated between the ends of the legs of an essentially U-shaped core with at least one coil of wire wrapped around the core's jaws;

locking said object in place between the legs;

feeding said coils alternating current of suitable amperage and frequency to achieve inductive heating with a magnetic field in said object;

monitoring heat by one or more heat registering cameras and controlling said heating by adjustment heating parameters or conditions until an intended temperature condition has been obtained for the object; and adjusting heat transfer in the object by changing a position of a displaceable core jaw attached to said legs and extendable coil inserts attached to either the core or the core jaws.

2. A method according to claim 1, wherein heat transfer to said object is controlled by changing adapters connected to either the core jaws or the legs.

3. A method according to claim 1, wherein several objects are heated concurrently and a next one of the objects that is scheduled to be removed is monitored and heating is controlled to provide a predetermined condition for said object.

4. A method according to claim 1, wherein several objects in a group are heated concurrently and a next pair of said group that are scheduled to be removed are monitored; the next object to be removed of said pair is maintained at a suitable temperature by controlling magnetic field around said object, and heating is reduced to maintain the second object of said pair at an intended temperature once a proper temperature has been reached.

5. A method according to claim 1, further comprising the step of heating the center of an extrusion tool to a higher temperature than area around the outer edge of said tool.

6. A method according to claim 1, wherein a tool after it is used for extrusion is placed in the heating area and its heating profile is registered with the cameras and stored; the tool is monitored for a sufficient time to allow an interpolation of its inner temperature; and the tool is heated again, the heating being controlled to produce a similar heating profile.

7. A device for inductive heating comprising an essentially U-shaped core with legs of said core against two core jaws;

said core jaws being displaceable from each other and being lockable in position around an object to be heated;

at least one coil being wrapped around said core for handling suitable amperage and frequency needed to achieve inductive heating;

an extendable coil insert attached to either the core or the core jaws; and one or more cameras are arranged around the core.

8. A device for inductive heating according to claim 7, wherein said core jaw on the side facing said object to be heated has mountable adaptation means for controlling magnetic flux in the vicinity of said object.

9. A device for inductive heating according to claim 7, and further including adaption pieces having flanges or panels that can grip over the core jaws laterally, said panels or flanges being provided with downwards facing recesses with oblique side edges that can grip over pins projecting laterally out from the core jaws so that said adaption pieces can be mounted from above and by their own weight be drawn against the core jaws when slid downwards along the oblique edge of said pins.

10. A device for inductive heating according to claim 7, and further including moveable core pieces for accommodating objects with different topological surface structures.

* * * * *